US006181065B1

(12) United States Patent
Huettinger et al.

(10) Patent No.: US 6,181,065 B1
(45) Date of Patent: Jan. 30, 2001

(54) METAL HALIDE OR SODIUM HIGH PRESSURE LAMP WITH CERMET OF ALUMINA, MOLYBDENUM AND TUNGSTEN

(75) Inventors: Roland Huettinger, Jesenwang; Dieter Lang, Bruckmuehl; Rita Tiedt, Mering, all of (DE)

(73) Assignee: Patent-Treuhand-Gesellschaft F. Elektrische Gluehlampen mbh, Munich (DE)

( * ) Notice: Under 35 U.S.C. 154(b), the term of this patent shall be extended for 0 days.

(21) Appl. No.: 09/103,365

(22) Filed: Jun. 23, 1998

(30) Foreign Application Priority Data

Jun. 27, 1997 (DE) ..... 195 27 429

(51) Int. Cl.[7] ..... H01J 17/18; H01J 61/36
(52) U.S. Cl. ..... 313/625; 313/567
(58) Field of Search ..... 313/567, 623, 313/624, 625

(56) References Cited

U.S. PATENT DOCUMENTS

| | | | | |
|---|---|---|---|---|
| 3,564,328 | | 2/1971 | Bagley et al. . | |
| 4,155,758 | | 5/1979 | Evans et al. . | |
| 4,602,956 | | 7/1986 | Partlow et al. . | |
| 4,972,119 | * | 11/1990 | Kariya et al. | 313/624 |
| 5,404,078 | | 4/1995 | Bunk et al. . | |
| 5,424,608 | * | 6/1995 | Juengst et al. | 313/623 |
| 5,424,609 | * | 6/1995 | Geven et al. | 313/623 |
| 5,484,315 | | 1/1996 | Juengst et al. . | |
| 5,592,049 | | 1/1997 | Heider et al. . | |
| 5,637,960 | | 6/1997 | Juengst et al. . | |
| 5,661,367 | * | 8/1997 | Fellows et al. | 315/59 |
| 5,742,124 | * | 4/1998 | Kees et al. | 313/625 |

FOREIGN PATENT DOCUMENTS

| | | |
|---|---|---|
| 1923138 | 11/1969 | (DE) . |
| 0136505 A2 | 4/1985 | (EP) . |
| 0528428 A1 | 2/1993 | (EP) . |
| 0609477 A1 | 8/1994 | (EP) . |
| 0 650 184 A1 | 4/1995 | (EP) . |

* cited by examiner

*Primary Examiner*—Nimeshkumar D. Patel
*Assistant Examiner*—Matthew J. Gerike
(74) *Attorney, Agent, or Firm*—Frishauf, Holtz, Goodman, Langer & Chick, P.C.

(57) ABSTRACT

At least at one end of a discharge lamp, for example a metal-halide discharge lamp or a sodium high-pressure discharge lamp, which has a ceramic discharge vessel (4), a feed-through (9, 10; 30) is provided which includes a cermet. The cermet may be in pin or capillary tube form, and has a metal content which is so high that it can be welded like a metal. The cermet can be directly sintered into an end plug (26) or into an end portion (34*a*, 34*b*) of the vessel itself. The seal thus is effected by a sealing arrangement (11, 21, 34*a*, 34*b*, *31*) devoid of glass melt, which would be degraded by attack of corrosive fills within the lamp, while additionally having the capability of withstanding higher operating temperatures.

25 Claims, 2 Drawing Sheets

METAL HALIDE OR SODIUM HIGH PRESSURE LAMP WITH CERMET OF ALUMINA, MOLYBDENUM AND TUNGSTEN

Reference to related patents and applications, the disclosures of which are hereby incorporated by reference:

U.S. Pat. No. 4,155,758, Evans
U.S. Pat. No. 5,484,315, Juengst et al
U.S. Pat. No. 4,602,956, Partlow et al.
U.S. Pat. No. 5,404,078, Bunk et al.
U.S. Pat. No. 5,424,609, Geven et al.
U.S. Pat. No. 5,637,960, Juengst et al.
U.S. Pat. No. 5,592,049, Heider et al.
U.S. Ser. No. 09/103365, filed Jun. 23, 1998, Nagayama based on application PCT/JP93/00959, U.S.-designated, published as EP 0 650 184 A1.

Reference to related copending applications, assigned to the assignee of the present application or to a company within the corporate structure thereof, the disclosures of which are hereby incorporated by reference:

U.S. Ser. No. 09/103,364 , filed Jun. 23, 1998, Juengst claiming priority German Appl. 197 27 428.5, filed Jun. 27, 1997,
U.S. Ser. No. 09/102,067, filed Jun. 22, 1998, Juengst and Huettinger claiming priority German Appl. 197 27 430.7, filed Jun. 27, 1997,
U.S. Ser. No. 08/883,939, filed Jun. 27, 1997, Wei, Juengst, Thibodeau, Severian
U.S. Ser. No. 08/883,852, filed Jun. 27, 1997, Wei and Juengst

FIELD OF THE INVENTION

The present invention relates to a high-pressure discharge lamp, and more particularly to a metal-halide discharge lamp having a ceramic discharge vessel, and especially to an arrangement to provide for long-term sealed passage of an electrical lead-through or feed-through from the exterior into the interior of the discharge vessel.

BACKGROUND

Discharge lamps, and particularly high-power metal-halide discharge lamps, present problems in connection with reliable long-term seal of an electrical lead-through into a ceramic discharge vessel. Ceramic plugs are customarily used. There are many proposals for solutions to the problems. A pin or a tubular element of a metal, such as tungsten or molybdenum, is used as the electrical conductor. The plug may be of ceramic, and the pin or tube is melt-sealed by means of a glass melt or a melt ceramic into the plug. Alternatively, the lead-through may be directly sintered to the plug. The connection between the ceramic and the metal is not a secure bond however, so that the seal has a limited lifetime. It has also been proposed to use a cermet, which is a combination material formed of ceramic and metal, as the material for the plug—see U.S. Pat. No. 5,404,078, Bunk et al., and U.S. Pat. No. 5,592,049, Heider et al.

Plugs have been tested which comprise a plurality of layers of cermet with different relationships of metal to ceramic to provide for better matching of thermal coefficients of expansion. European EP 0 650 184 A1, Nagayama, to which U.S.-designated PCT/JP93/00959 corresponds, discloses a non-conductive cermet plug having axially arranged layers. This seal is very complex and uses a lead-through which has a thread, an outer metal disk or flange, and a metal or glass melt.

U.S. Pat. No. 4,602,956, Partlow et al., discloses a metal-halide discharge lamp having a ceramic discharge vessel.

The electrode is carried in a lead-through which is formed as a disk of electrically conductive cermet. The electrode is sintered into the cermet. Additionally, the lead-through is surrounded by a ring-shaped stopper or plug of cermet which is connected with the ceramic discharge vessel, typically of aluminum oxide, by a glass melt. The glass melt, however, is corroded by aggressive components of the fill in the discharge lamps, particularly by the halides therein, so that the lifetime of such a lamp is rather short. Embedding the electrode in the cermet lead-through, additionally, leads to stresses which eventually may lead to fissures and cracks in the cermet. The diameter of the disk lead-through is quite large. The lead-through is electrically conductive and, thus, the discharge arc can flash back or arc back to the lead-through which would quickly lead to blackening of the discharge vessel.

U.S. Pat. No. 4,155,758, Evans, describes a special arrangement for a metal-halide lamp having a ceramic discharge vessel without an outer surrounding envelope. The lead-through is formed as a pin of electrically conductive cermet. The electrode is sintered into the cermet. The cermet pin in turn is sintered into a plug of aluminum oxide, and this plug is connected to the vessel by a glass melt. This arrangement also has the disadvantages above mentioned.

U.S. Pat. No. 5,424,609, Geven et al., describes a metal-halide discharge lamp which requires an extremely long-drawn capillary tube of aluminum oxide as an inner plug element. A pin-like metallic lead-through is connected by a glass melt at the outer end in a melting zone. It is important that the melting zone is at a sufficiently low temperature. The lead-through pin can be made of two parts, in which the part facing the discharge can be made of an electrically conductive cermet, which contains carbide, silicide or a nitride. The sealing technology results in a large overall length of the discharge vessel, it is expensive to make and, also, uses the corrosion-susceptible glass melt. The gap between the capillary tube and the lead-through results in a comparatively large dead volume in which a substantial portion of the fill in the lamp may condense, so that a large quantity of fill is necessary. The aggressive fill has intensive contact with the corrosion-susceptible components in the sealing region.

SUMMARY OF THE INVENTION

It is an object to provide a high-pressure discharge lamp having a ceramic discharge vessel, typically retaining a fill which includes a halide, which has a long lifetime, and in which electrical conductors leading from the outside into the inside of the ceramic discharge vessel are sealingly retained without use of glass or ceramic melts. The sealing regions including the sealing means used therein are required to be vacuum-tight, resistant to high temperatures, and to corrosive attack by the fill of the lamp.

Briefly, the closing and sealing means for tubular end portions of the discharge vessel include a lead-through or feed-through which comprises a cermet structure, in which the cermet has a metal content which is so high that it can be welded like a metal. The cermet structure is directly sintered into the sealing or closing means or arrangement; and the sealing or closing arrangement or sealing or closing means, in turn, is directly sintered to the respective end portion of the discharge vessel.

Use of a cermet as at least a part of the feed-through permits a tight bond connection without use of a glass melt. This cermet structure is directly sintered to the surrounding sealing means or sealing arrangement. This direct sinterconnection does not join any simply metallic partner so that a high vacuum tight bond can be formed, which is a definite requirement for a long lifetime—reliably more than 10,000 hours of operation.

The connection partners which are directly sintered both shrink during sintering. This permits a better matching of the at least partly cermet feed-through to the sealing means or sealing arrangements which, likewise, shrink. The thermal coefficients of expansion of the respective partners—feed-through and sealing means—are closer together than when the feed-through itself is metallic. This reduces stresses upon temperature change which results when the lamp is turned ON and OFF.

The cermet partner or cermet structure of the feed-through may be formed as a pin, or as a capillary tube. In either case, the mass of this structure is very small. In case of a pin, the outer diameter of the cermet structure is small; in case of a capillary tube, the wall thickness of the tube can be made small. Thus, absolute differences in expansion upon changes in temperature, and temperature loading due to temperature changes, will be small. The end face which is directed towards the discharge is relatively small, so that back-arcing can be readily avoided.

The cermet structure is connected to the electrode, and particularly to an electrode shaft, directly or indirectly, over an additional structural element by welding. Stresses in this region are also largely avoided since the electrode shaft is not sintered in the feed-through.

The present invention is specifically directed to a high-pressure discharge lamp having a ceramic discharge vessel, which is typically of aluminum oxide, but may be aluminum nitride or aluminum oxinitride, and which is formed as a metal-halide or sodium high-pressure lamp. Customarily, the discharge vessel is surrounded by an outer envelope. The discharge vessel has two ends which are closed by closing and sealing means. These closing and sealing means may be unitary or multi-part plugs or stoppers, or may be formed directly on the vessel by suitably shaped integral ends of the discharge vessel itself.

At least one end of the discharge vessel has a construction which includes a central bore of the sealing means through which an electrical feed-through passes vacuum tightly. An electrode or, rather, an electrode shaft, is secured to the feed-through, the electrode extending into the interior of the discharge vessel. The feed-through includes a cermet structure, the metal content of which is so high that it can be welded just like a metal. The cermet structure is sealed in the sealing means by direct sintering without use of a glass melt. The sealing means itself is secured in the discharge vessel by direct sintering, without use of a glass melt. Consequently, the entire feed-through connection is devoid of any glass melt. The ceramic portion of the cermet is aluminum oxide or aluminum nitride or aluminum oxinitride; the metallic portion of the cermet is tungsten, molybdenum, or rheniums, or alloys of tungsten, molybdenum or rhenium. The principal structure of materials for cermets is known per se, see for example U.S. Pat. No. 5,404,078, Bunk et al., and U.S. Pat. No. 5,592,049, Heider et al., both assigned to the assignee of the present application. In accordance with a feature of the invention, the material of the cermet structure must be weldable. In accordance with some embodiments, it should also be electrically conductive, although this is not always a necessary feature. An example of a weldable and electrically conductive cermet is: 50%, by volume, metal, the remainder aluminum oxide.

When using tungsten or molybdenum as the metal component in the cermet, weldability can be obtained already from about 35% to 40%, by volume, of the metal component; for electrical conductivity: 45%, by volume, of the metal is sufficient.

Various examples of proportions of metal and ceramic are also given in the copending applications listed on the first page of this application, the disclosures of which are hereby incorporated by reference.

In accordance with a particularly preferred embodiment, the cermet structure of the feed-through is a pin of electrically conductive cermet. The pin is butt-welded to the shaft of the electrode. This arrangement is particularly suitable for higher powered lamps, that is, 100 W and up. Usually, the cermet pin forms the only structural element of the feed-through. It is possible, however, to use multi-part feed-through arrangements. The pin itself is directly sintered into the sealing means.

In accordance with a preferred feature, the sealing means is a ring-shaped plug. The plug is, entirely or partly, and if partly, essentially the innermost part, made of an electrically non-conductive cermet. The plug can be made of a plurality of concentric parts. The innermost plug part, preferably, is a capillary tube of short length, which is surrounded at the outside by a further ring-shaped plug part. This further plug part is made of a cermet with low metal content or just aluminum oxide, or the like. This ensures that, with respect to thermal coefficient of expansion, a gradually, step-wise, radially directed transition to the discharge vessel itself is obtained.

Preferably, the feed-through or lead-through is seated in the sealing means within a recess, so that contact with the fill is minimized, and temperature loading is reduced.

In accordance with a second preferred embodiment, which is particularly suitable for lower power rated lamps, the cermet structure is a capillary tube made of cermet. The capillary tube is directly sintered in the sealing means or sealing arrangement. The electrical conductivity itself is not of substantial importance. What is important is the weldability of the capillary tube due to a sufficiently high proportion of metal within the cermet. Electrical conductivity of the capillary tube can be accepted. To prevent back-arcing, it is desirable to locate the capillary tube in the sealing arrangement within a blind hole or a recess protected from the discharge.

In acccordance with this second embodiment, the feed-through is made of at least two parts. In addition to the capillary tube, the feed-through includes an electrically conductive pin surrounded by the capillary tube.

The feed-through pin preferably is made of tungsten, molybdenum or may be an electrically conductive cermet. Preferably, the pin is welded to the capillary tube at the end of the capillary tube remote from the discharge region. A very narrow gap will remain between the pin and the surrounding capillary tube in order to compensate for different thermal expansion.

The pin may itself serve as the electrode shaft or may be a support and then connected to the electrode shaft. It can extend at the outside beyond the capillary tube in order to facilitate connection to an external current supply.

DRAWINGS

DETAILED DESCRIPTION

Figure 1:
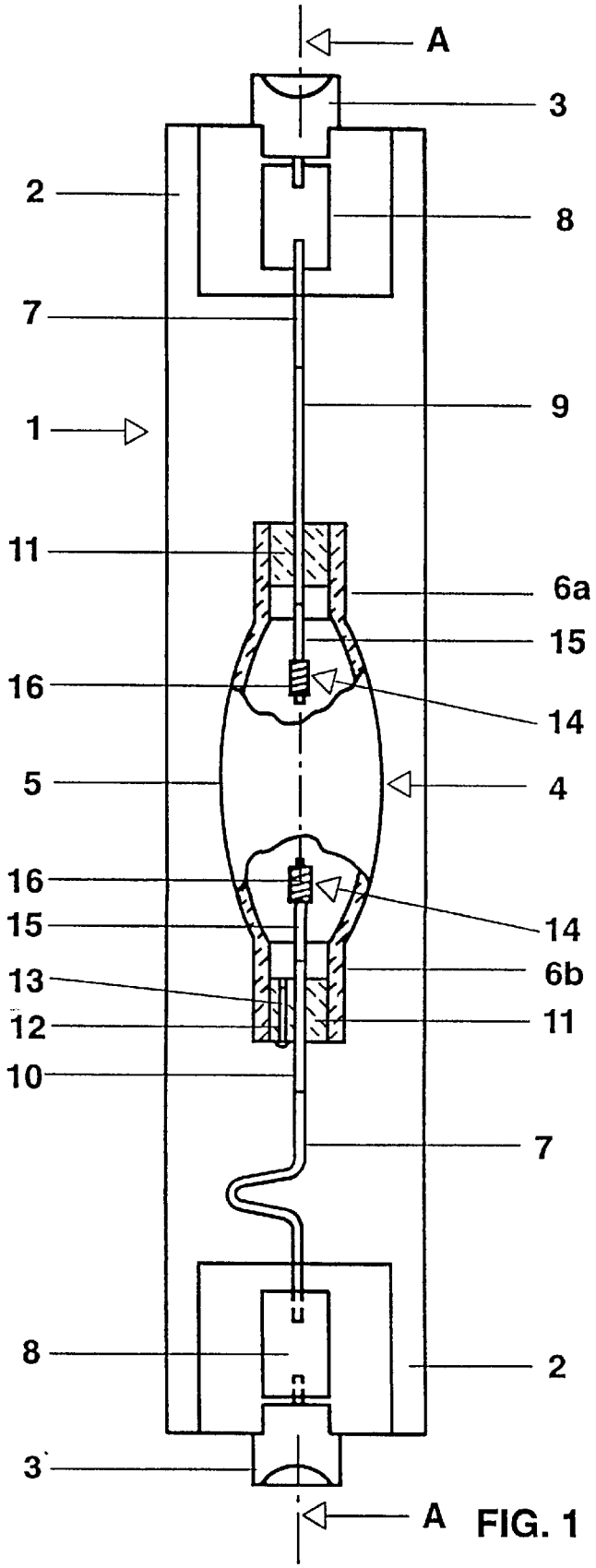
FIG. 1 is a schematic side view of a metal-halide discharge lamp with a ceramic discharge vessel.

FIG. 1, highly schematically, illustrates a metal-halide discharge lamp of a power rating of 150 W. It has a cylindrical outer envelope 1 of quartz glass which defines a longitudinal lamp axis A. The envelope is pinch-sealed (2) at its two ends to which respective bases 3 are attached. A discharge vessel 4 is axially located in the envelope. It is made of $Al_2O_3$ ceramic. It is bulged outwardly in the center region 5 and has two tubular cylindrical ends 6*a*, 6*b*. Two current supply leads 7 are coupled to the base portions 3 through connecting leads via melted-in pinch-sealed foils 8. Leads 7 retain the discharge vessel 4 within the envelope 1 in axial position. The current supply leads 7 are welded to lead-throughs or feed-throughs 9, 10 which, each, are fitted in a respective plug 11 in the end portions 6*a*, 6*b* of the discharge vessel 4. Plugs 11 form a closing and sealing means for the discharge vessel, through which respective feed-throughs 9, 10 pass.

The feed-throughs 9, 10 are cermet pins having a diameter of about 1 mm. The cermet is conductive and weldable. It is made of about 50%, by weight, molybdenum, the remainder aluminum oxide.

Both feed-throughs 9, 10 extend inwardly beyond the plug 11 and, at the discharge end, hold electrodes 14. The electrodes 14 each have an electrode shaft 15 of tungsten on which a wrapping or winding 16 is attached at the discharge end. The feed-throughs 9, 10 are butt-welded to the respective electrode shafts 15, and also butt-welded to the outer current supply leads 7.

The discharge vessel retains a fill which has an inert ignition gas, for example argon, and mercury, as well as metal-halide additives. It is also possible to use a metal-halide fill without mercury, and then use xenon under high pressure as the ignition gas.

The end plugs 11 are made of essentially only $Al_2O_3$. It is also possible to use a non-conductive and non-weldable cermet, in which $Al_2O_3$ is the main component, and which has metallic components of tungsten of about 30%, by weight. Molybdenum, with a correspondingly higher proportion, is also suitable. Other possibilities for a suitable composition of the cermet are disclosed in the prior art described in the introduction to this application.

The feed-through 9, 10 is directly sintered in the respective plug 11. Similarly, the plug 11 is directly sintered in the cylindrical end portions 6*a*, 6*b* of the discharge vessel. This direct sintering does not use glass melt, so that the connection is devoid of a glass melt.

The plug 11 at the second end portion 6*b* has a bore 12 parallel to the axis A of the lamp. This bore 12 is used to evacuate and fill the discharge vessel, as well known. After filling, the bore 12 is closed by a pin 13, known in the industry as a stopper, which is closed by a melt ceramic. The pin customarily is made of ceramic or cermet. Various arrangements of this technology are known and described for example in U.S. Pat. No. 4,155,758, Evans; U.S. Pat. No. 5,484,315, and U.S. Pat. No. 5,637,960, Juengst et al.

Basically, a cermet pin is suitable as a feed-through, in which the cermet contains, besides aluminum oxide, at least 40% metal—preferably between about 45% and 75%—all percentages by volume—which is weldable and can be electrically conductive. Particularly suitable are 70% to 90% by weight tungsten, or 55% to 80% by weight molybdenum, or, with respect to the volume, equivalent quantities of rhenium. The end plug can be made of a cermet material which has a lower metallic content than the feed-through, preferably about half of the metal proportion of the feed-through. Essential characteristics of the plug are that the thermal coefficient of expansion is between that of the feed-through and of the discharge vessel. The metallic component of the plug 11 can also be zero.

Welding of the electrode at the end surface of the feed-through is done before the feed-through is sintered into the plug. The weldable cermet pin is largely presintered before the final sintering into the plug.

Figure 2:
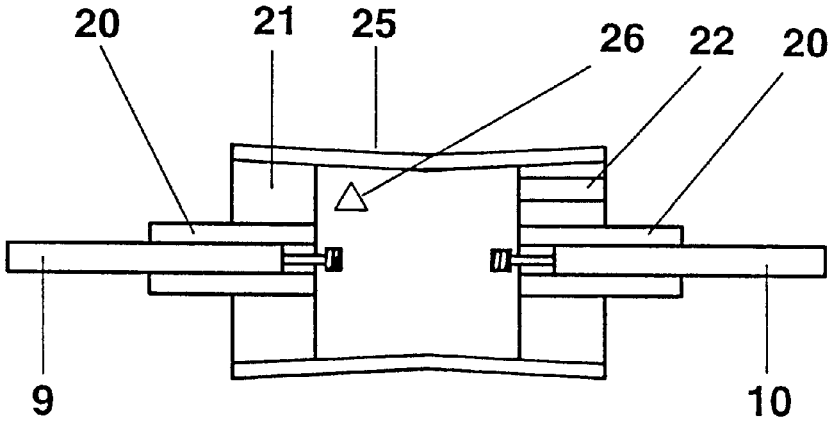
FIG. 2 is a schematic side view of a sealing arrangement for a ceramic discharge vessel.

In another embodiment—see FIG. 2—the discharge vessel 25 which is circular-cylindrical at the end portion, has a non-conductive plug 26 directly sintered thereinto. The feed-through, again, is an electrically conductive cermet pin 9, 10, with a composition as above described. Preferably, the metallic component is selected to be 50%, by volume that is, higher than described above. The plug 26 is made of aluminum oxide and has two concentric parts, one outer ring-shaped plug part 21 and an inner capillary tube 20 which is about twice as long as the plug part 21. The capillary tube, however, in comparison to known capillary technology is about 50% shorter than prior art capillary tubes. The comparatively long length of the capillary tube 20, with respect to the plug part 21, improves the sealing performance. The cermet pin 9 is set into the capillary tube 20 within a recess, and there directly sintered therein. The fill bore 22, in the right-side plug 26, is located in a radially outer region of the plug part 21.

The plug, in accordance with another embodiment of the invention, is constituted of a plug part 21 which is a non-conductive cermet, having a metallic component which is less than that of the capillary tube. A suitable metallic component is about 10%, by volume, tungsten. The capillary tube 20 is made of non-conductive and non-weldable cermet of about 20% by volume tungsten. The advantage of this arrangement is better grading or staggering of the respective thermal coefficients of expansion, due to the different proportions of the metal content of the respective elements. The metal content decreases from the inside or central axial part outwardly, in case only the same metal is used for all parts, for example tungsten. The capillary tube 20 may also be made of non-conductive and non-weldable cermet or of aluminum oxide.

Of course, the cermet pin can also be set into a single-part plug 26 with a recess at the discharge side—see FIG. 1.

Figure 3:
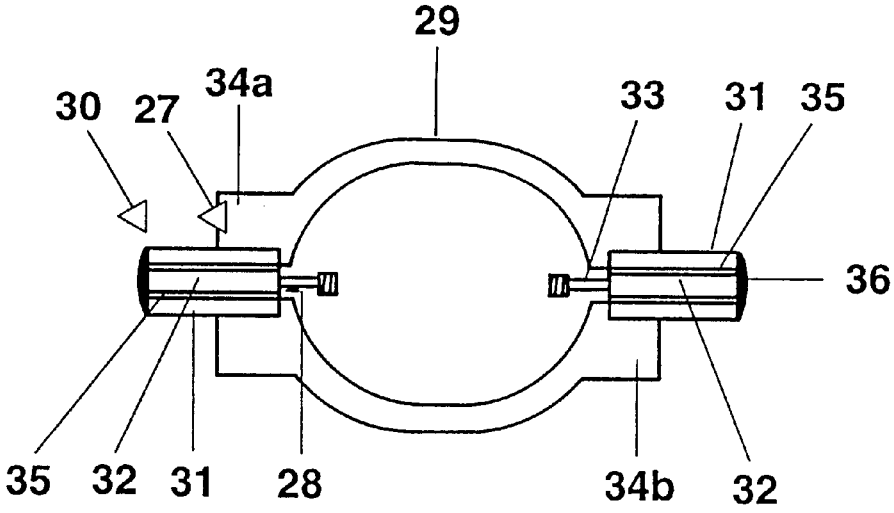
FIG. 3 is a third embodiment of a seal for a ceramic discharge vessel, in which the sealing means or sealing arrangement is integral with the vessel structure itself.

FIG. 3 illustrates another embodiment of a discharge vessel for a metal-halide lamp of small power rating, for example about 35 W. The discharge vessel 29 of aluminum oxide is bulged outwardly and is formed with end portions of reduced diameter. These end portions directly form the sealing arrangement or sealing means or sealing arrangement 34*a*, 34*b*. They are formed, at their outer regions, similar to a plug. Of course, the vessel could also be made with open ends for insertion of a separate plug.

The sealing arrangement 34*a*, 34*b* is formed with a central opening 27 which constricts, in a step, to a through-opening 28. The feed-through 30 is made of two parts: a short capillary tube 31 of weldable cermet which is fitted in the wider part of the partially blind bore 27 and directly sintered therein. This capillary tube 31 of weldable cermet surrounds an electrically conductive pin 32. At the inner end, facing the discharge, an electrode shaft 33 is butt-welded on the respective conductive pin 32. The pin 32 is made of an electrically conductive cermet or of metal, especially molybdenum. The pin 32 terminates, at the discharge side, in the through-opening 28 or, in another and preferred embodiment, already within the capillary tube 31.

The discharge vessel 29 (FIG. 3) is filled and evacuated by first sintering only the capillary tube 31 to one sealing arrangement, for example at the end 34*b*, without, however, introducing the feed-through pin at the time. After filling, the feed-through pin 32 (together with the electrode) is introduced into the capillary tube 31 up to the through-opening 28. The outer ends of the pin 32 and the capillary tube 31 are then welded in the region of the outer end of the pin 32, as schematically shown at 36, for example by a laser or plasma burner. Capillary tube 31 thus also becomes part of the sealing arrangement for the lamp.

This technology has the advantage that, upon welding to close the discharge vessel 29 together with the fill already therein, the vessel and the fill remain relatively cool. No vaporization of the fill has to be feared during the welding step. In this arrangement, again, no glass melt or ceramic melt is required, which previously was needed to close the fill bore. This arrangement is particularly advantageous for lower power rated lamps. Lower power lamps have such small dimensions that space for a separate, eccentric fill bore is not available. Due to the smaller heat capacity of low-wattage, low-power lamps, the problem of heating of the lamp is more critical.

The arrangement can also be used only at one end of the discharge vessel, the feed-through at the other end being done in conventional manner or, for example, in accordance with the embodiment described in connection with FIG. 1.

The choice of material can be based on many considerations. In one embodiment, the capillary tube and the feed-through can use the same electrically conductive material, that is, a cermet with a high metal content. In this case, a plug with a blind or dead bore is desirable in order to prevent back-arcing of the discharge arc. Use of the same materials has the additional advantage that two parts utilizing the same material can be welded particularly easily, and have essentially the same thermal behavior. The gap 35 between the capillary tube 31 and the pin 32, shown highly exaggerated, can be held to a very small dimension, as small as possible. Condensation of fill in this gap is thus a minimum.

In a second and variant embodiment, the metal proportion of the pin 32 can be selected to be higher than that of the capillary 31. In this case, only the pin is electrically conductive. It may be about 45% by volume of tungsten. The capillary tube is only weldable, that is, containing only about 35% to 40% by volume of tungsten. In that case, the dead bore or blind bore 27 need not be used. The capillary tube can be flush at the inside with the plug portion of the discharge vessel.

The pin 32, when it is metal, may extend at the outside beyond the capillary tube 31, so that an external current supply can be easily welded thereto. The outer or external current supply may also be formed with a tubular end which surrounds the capillary tube.

Typical dimensions are as follows: outer diameter of capillary tube 31: 2–3 mm, in dependence on the power rating of the lamp. Diameter of pin 32, at low power of 35 W: typically 0.6 mm. The gap between the pin 32 and the capillary tube 31 is a few tens of $\mu$m, for example about 40 $\mu$m.

A sealing technology of this type, devoid of glass melt, can accept temperatures up to about 1000° C. When glass melt is used, temperatures of only up to about 700° C. are permissible. A substantial advantage of the structure in accordance with the present invention is the short axial length. The axial length of the capillary tube 31 can be reduced by 50% to 70% over a construction as described, for example, in U.S. Pat. No. 5,424,609, Geven et al. Due to the shortened and constricted gap between the pin 32 and the capillary tube 31, the required quantity of fill can be reduced by about 50%.

The metal component of the cermet, preferably, uses tungsten, particularly when corrosion resistance of the feed-through or an element thereof is of primary importance. Molybdenum is preferred when thermal matching is particularly critical.

As an example, suitable cermet compositions are: When using tungsten as the metal partner of the cermet, weldability is ensured from about 35% to 40% by volume tungsten. Electrical conductivity is sufficient from about 45% by volume of tungsten. For molybdenum, the metal component must be increased by a factor of about 1.5.

Various changes and modifications may be made, and any features described herein in connection with any one embodiment may be used with any of the others, within the scope of the inventive concept.

We claim:

1. A high-pressure discharge lamp comprising:

a ceramic discharge vessel (4) having two tubular end portions (6*a*, 6*b*);

a closing and sealing means (11, 21, 34*a*, 34*b*, 31) closing each of said tubular end portions;

an electrically conductive feed-through or lead-through (9, 10; 30) which passes through said each of said closing and sealing means in a vacuum-tight manner;

an electrode (14, 28) secured to each feed-through and extending into the interior of the discharge vessel (4), wherein at least at one end portion (6*a*) of the lamp, the feed-through (9, 10; 30) comprises a cermet structure having a metal content which is so high that it is capable of being welded like a metal, said cermet structure being in direct contact with and being directly sintered into said closing and sealing means (11, 21, 34*a*, 34*b*, 31) without using a glass melt or a ceramic sealing component; and wherein said closing and sealing means is in direct contact with and being directly sintered into the respective end portion (6*a*, 6*b*) of the discharge vessel without using a class melt or a ceramic sealing component.

2. The lamp of claim 1, wherein the electrode (14) has an electrode shaft; and wherein the cermet structure comprises a pin (9, 10) formed of an electrically conductive cermet, the electrode shaft (15) being butt-welded at an end face of said pin; and wherein said pin (9, 10) forms the sole structural element of said feed-through.

3. The lamp of claim 2, wherein the closing and sealing means (11, 21) comprises a ring-shaped plug of an electrically non-conductive cermet.

4. The lamp of claim 2, wherein said closing and sealing means comprises a capillary tube (20) of an electrically non-conductive cermet.

5. The lamp of claim 2, wherein the feed-through (9, 10) is seated in the closing and sealing means (20) within a recess located at the discharge side of the closing and sealing means.

6. The lamp of claim 1, wherein the feed-through (30) comprises a capillary tube (31).

7. The lamp of claim 6, wherein said capillary tube (31) is located in a stepped recessed dead bore (27), protected from the discharge within the discharge vessel.

8. The lamp of claim 6, wherein said feed-through (30) further comprises an electrically conductive pin (32) located within the capillary tube (31).

9. The lamp of claim 8, wherein said pin (32) comprises tungsten or molybdenum or an electrically conductive cermet.

10. The lamp of claim 8, wherein said pin (32) and the capillary tube (31) are welded together at an end portion remote from the discharge end.

11. The lamp of claim 8, further comprising a narrow gap (35) between the pin (32) and the surrounding capillary tube (31).

12. The lamp of claim 1, further comprising an outer envelope (1) surrounding the discharge vessel.

13. The lamp of claim 1, further comprising a metal-halide fill within the discharge vessel (4).

14. A high-pressure discharge lamp comprising:

a ceramic discharge vessel (4) having two tubular end portions **(6*a*, 6*b*)**;

a closing and sealing means **(34*a*, 34*b*, 31)** closing each of said tubular end portions;

an electrically conductive feed-through or lead-through (30) which passes through said each of said closing and sealing means in a vacuum-tight manner;

an electrode (14, 28) secured to each feed-through and extending into the interior of the discharge vessel (4), wherein at least at one end portion **(6*a*) of the lamp, the feed-through (30) comprises a cermet structure having a metal content which is so high that it is capable of being welded like a metal, said cermet structure being in direct contact with and being directly sintered into said closing and sealing means (11, 21, 34*a*, 34*b*, 31) without using a glass melt or a ceramic sealing component; and wherein said closing and sealing means comprises at least part (34*a*, 34*b*) of said tubular end portions of the discharge vessel, said cermet structure (30)** being in direct contact with and being directly sintered into said parts of the tubular end portion without using a glass melt or a ceramic sealing component.

15. The lamp of claim 14, wherein said closing and sealing means includes a capillary tube (31) directly sintered into the respective part **(34*a*, 34*b*, 31) of the respective end portion (6*a*, 6*b*)** of the vessel.

16. The lamp of claim 14, wherein said capillary tube (31) is located in a stepped recessed dead bore (27), protected from the discharge within the discharge vessel.

17. The lamp of claim 14, wherein said feed-through (30) further comprises an electrically conductive pin (32) located within the capillary tube (31).

18. The lamp of claim 17, wherein said pin (32) comprises tungsten or molybdenum or an electrically conductive cermet.

19. The lamp of claim 17, wherein said pin (32) and the capillary tube (31) are welded together at an end portion remote from the discharge end.

20. The lamp of claim 17, further comprising a narrow gap between the pin (32) and the surrounding capillary tube (31).

21. The lamp of claim 1, wherein the discharge vessel is made of aluminum oxide.

22. The lamp of claim 11, wherein the gap has a width in the order of a few tens of micrometers.

23. The lamp of claim 6, wherein said feed-through further comprises an electrically conductive pin located within the capillary tube; and said connective pin and the capillary tube are welded together at an end portion remote from the discharge end.

24. The lamp of claim 14, wherein the discharge vessel is made of aluminum oxide.

25. The lamp of claim 20, wherein the gap has a width in the order of a few tens of micrometers.

* * * * *